US009874186B2

(12) United States Patent
Aleker et al.

(10) Patent No.: US 9,874,186 B2
(45) Date of Patent: Jan. 23, 2018

(54) CYLINDER HEAD BLANK, CYLINDER HEAD AND HIGH-PRESSURE PUMP FOR FUEL INJECTION SYSTEMS

(71) Applicant: Robert Bosch GmbH, Stuttgart (DE)

(72) Inventors: Jochen Aleker, Stuttgart (DE); Arnold Gente, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 330 days.

(21) Appl. No.: 14/774,364

(22) PCT Filed: Jan. 13, 2014

(86) PCT No.: PCT/EP2014/050475
§ 371 (c)(1),
(2) Date: Sep. 10, 2015

(87) PCT Pub. No.: WO2014/139695
PCT Pub. Date: Sep. 18, 2014

(65) Prior Publication Data

US 2016/0025055 A1 Jan. 28, 2016

(30) Foreign Application Priority Data

Mar. 13, 2013 (DE) ..... 10 2013 204 327

(51) Int. Cl.
*F02M 59/44* (2006.01)
*F02M 59/02* (2006.01)
(Continued)

(52) U.S. Cl.
CPC ..... *F02M 59/44* (2013.01); *F02M 59/02* (2013.01); *F02M 59/025* (2013.01);
(Continued)

(58) Field of Classification Search
CPC ..... F02M 59/44; F02M 59/48; F02M 59/02; F02M 59/025; F02M 59/027; F02M 59/102; F04B 39/123; F04B 39/125
See application file for complete search history.

(56) References Cited

U.S. PATENT DOCUMENTS 4,430,977 A 2/1984 Shimada
4,621,986 A * 11/1986 Sudo ..... F01C 21/0872 417/304
(Continued)

FOREIGN PATENT DOCUMENTS

DE 102008043500 A1 * 7/2010 ..... F02M 59/102
DE 102009003054 11/2010
(Continued)

OTHER PUBLICATIONS

International Search Report for Application No. PCT/EP2014/050475 dated Apr. 10, 2014 (English Translation, 2 pages).

*Primary Examiner* — Erick Solis
*Assistant Examiner* — Anthony L Bacon
(74) *Attorney, Agent, or Firm* — Michael Best & Friedrich LLP

(57) ABSTRACT

The invention relates to a cylinder head blank (9) for a high-pressure pump (1), which is in particular configured as a radial or in-line piston pump for fuel injection systems of air-compressing, auto-ignition internal combustion engines, comprising a base (10) having a high-pressure outlet (16) and a plurality of low-pressure connecting points (13-15). Here, the plurality of low-pressure connecting points (13-15) are closed in a raw state, wherein a low-pressure connection (11) can be fitted to each of the low-pressure connecting points (11). The invention further relates to a cylinder head for a high-pressure pump (1) and to a high-pressure pump (1).

15 Claims, 3 Drawing Sheets

(51) Int. Cl.
*F02M 59/10* (2006.01)
*F02M 59/48* (2006.01)
*F04B 39/12* (2006.01)

(52) U.S. Cl.
CPC ..... *F02M 59/027* (2013.01); *F02M 59/102* (2013.01); *F02M 59/48* (2013.01); *F02M 2200/80* (2013.01); *F02M 2200/8053* (2013.01); *F02M 2200/8069* (2013.01); *F02M 2200/85* (2013.01); *F02M 2200/855* (2013.01); *F04B 39/123* (2013.01)

(56) References Cited

U.S. PATENT DOCUMENTS 4,903,661 A * 2/1990 Scott ..... F02D 1/04 123/373
6,289,875 B1 * 9/2001 Shinohara ..... F02M 39/005 123/450
7,488,161 B2 * 2/2009 Inoue ..... F04B 53/10 123/467
2003/0079726 A1 * 5/2003 Banzhaf ..... F02M 55/00 123/495
2006/0039811 A1 * 2/2006 Nieslony ..... F02M 59/464 417/490
2007/0020131 A1 * 1/2007 Schroeder ..... F02M 59/04 417/521
2007/0071614 A1 * 3/2007 Inoue ..... F02M 59/445 417/297
2012/0051951 A1 3/2012 Dutt
2012/0279721 A1 * 11/2012 Surjaatmadja ..... F04B 15/02 166/369

FOREIGN PATENT DOCUMENTS

DE 102012221611 A1 * 5/2014 ..... F04B 53/16
DE 102012224439 A1 * 7/2014 ..... F02M 59/44
EP 1770274 4/2007
JP 2012021525 A * 2/2012 ..... F02M 59/44
WO 2010049207 5/2010

* cited by examiner

CYLINDER HEAD BLANK, CYLINDER HEAD AND HIGH-PRESSURE PUMP FOR FUEL INJECTION SYSTEMS

BACKGROUND OF THE INVENTION

The invention relates to the field of high-pressure pumps, in particular radial or in-line pumps for fuel injection systems of air-compressing, auto-ignition internal combustion engines.

A high-pressure pump, which is used in particular as a radial or in-line pump for fuel injection systems of air-compressing, auto-ignition internal combustion engines, is known from the German patent publication DE 10 2009 003 054 A1. The known high-pressure pump comprises a pump assembly and a drive shaft which comprises a cam associated with the pump assembly. A cylinder head is furthermore provided. A piston of the pump assembly delimits a pump working chamber in the cylinder bore. Fuel from a fuel channel can be introduced into the pump working chamber via an intake valve provided on the cylinder head. An outlet valve is furthermore provided on the cylinder head. Fuel subjected to high pressure can be led via the exhaust valve out of the pump working chamber via a fuel channel which is connected to the common rail.

The high-pressure pump known from the German patent publication DE 10 2009 003 054 A1 has the disadvantage that the outlet direction for the low-pressure side is predefined by design. In this case, it is conceivable that the outlet direction can be changed with an additional component, which however means additional cost and effort and an additional space requirement.

SUMMARY OF THE INVENTION

The inventive cylinder blank, the inventive cylinder head and the inventive high-pressure pump have the advantage that an adaptation to different outlet directions for the high-pressure pump is enabled in an improved manner. In particular, an improved flexibility for different applications is implemented, wherein different directions for a high-pressure outlet and/or a low-pressure inlet are made possible.

It is advantageous for the low-pressure connecting points to be closed by an outer wall of the base in the raw state. With regard to the respective application, a threaded bore can then, for example, be configured at the desired low-pressure connecting point, so that the low-pressure inlet connecting piece can subsequently be screwed into the base. The base of the cylinder head blank can therefore be processed in an application specific manner, in particular soft-machined. The base can, in this case, particularly be configured as a forging blank. In a preferred manner, the base rests on a cylindrical contour.

It is furthermore advantageous for the low-pressure connecting points to be provided on radial projections of the base. Such radial projections can be designed as preformed projections on a forging blank in order to form the base. The high-pressure outlet can furthermore be configured as a preformed high-pressure outlet, to which a high-pressure screw connection of a fuel line or something similar can advantageously be connected without further machining. Hence, the cost and effort of machining that is still required can be reduced to an adaptation to the respective application.

It is furthermore advantageous for at least one mounting bracket to be integrally formed on the base. In a preferred manner, two mounting brackets are integrally formed on the base. The mounting brackets can thereby be provided with mounting recesses, in particular screw holes. An application specific machining of the mounting brackets is also possible in order to configure such mounting recesses at suitable positions on the mounting brackets.

It is furthermore advantageous for the high-pressure outlet, the plurality of low-pressure connecting points and the at least one mounting bracket to be at least approximately disposed at angular positions, which are integer multiples of a certain basic angle, on the base so as to be distributed around the perimeter thereof. Depending on the configuration, individual angular positions can also remain open. It is particularly advantageous for the determined basic angle to be equal to 45°. If two mounting brackets are provided, said brackets are then preferably disposed at angular positions opposite to one another. As a result, an advantageous force transmission for a reliable mounting is possible.

If the high-pressure outlet lies, for example, at the angular position of 0°, the mounting brackets can then lie at the angular positions of 45° and 225°. A mounting using mounting screws is possible to a plug-in pump of the motor, or something similar, via the mounting brackets, in particular screw brackets. The low-pressure connecting points can, for example, lie at angular positions of 90°, 180° and 270° with respect to the high-pressure outlet. In relation to the respective application, one of these angular positions can then be used for the low-pressure inlet connecting piece. In a modified embodiment, the mounting brackets can also lie at angular positions of −45° or, respectively, 315° and 135°. The low-pressure connecting points can then likewise lie at the angular positions of 90°, 180° and 270°.

The number of low-pressure connecting points is preferably 3, 4 or 5. Five low-pressure connecting points can, for example, lie at the angular positions of 90°, 135°, 180°, 225° and 315°, whereas the angle position 0°, 45° and 275° are occupied by the mounting brackets and the high-pressure outlet. Further modifications are conceivable here, in particular the angle between adjacent low-pressure points can also be set an angle that deviates from 90°.

In an advantageous manner, the high-pressure outlet and the low-pressure connecting point can be configured on a single base. In so doing, a flexible adaptation to the respective application is made possible without different components being required, namely on the one hand for the high-pressure outlet and on the other hand for the low-pressure inlet connecting piece, which can be rotated relative to one another. Sealing elements, in particular two O-rings, can thus be saved in the case of such a configuration, in which, for example, two housing parts are rotatably fitted on a cylinder head. In addition, the mounting is made easier.

A significant reduction in the required installation space results as a further advantage. In addition, a material and weight savings can be realized. Leakage problems can be prevented from the start by the elimination of low-pressure sealing points. The machining process is furthermore simplified because high-quality surfaces are not required at the relevant interfaces in the cylinder head.

There is furthermore the option of a modular configuration in the sense of a unit assembly system. In so doing, the required geometry can, if need be, be selected from different cylinder head blanks As a result, a further adaptation to different configurations can be achieved.

BRIEF DESCRIPTION OF THE DRAWINGS

Preferred exemplary embodiments of the invention are explained in detail in the following description with the aid of the attached drawings, in which corresponding elements are provided with matching reference signs. In the drawings.

DETAILED DESCRIPTION

Figure 1:
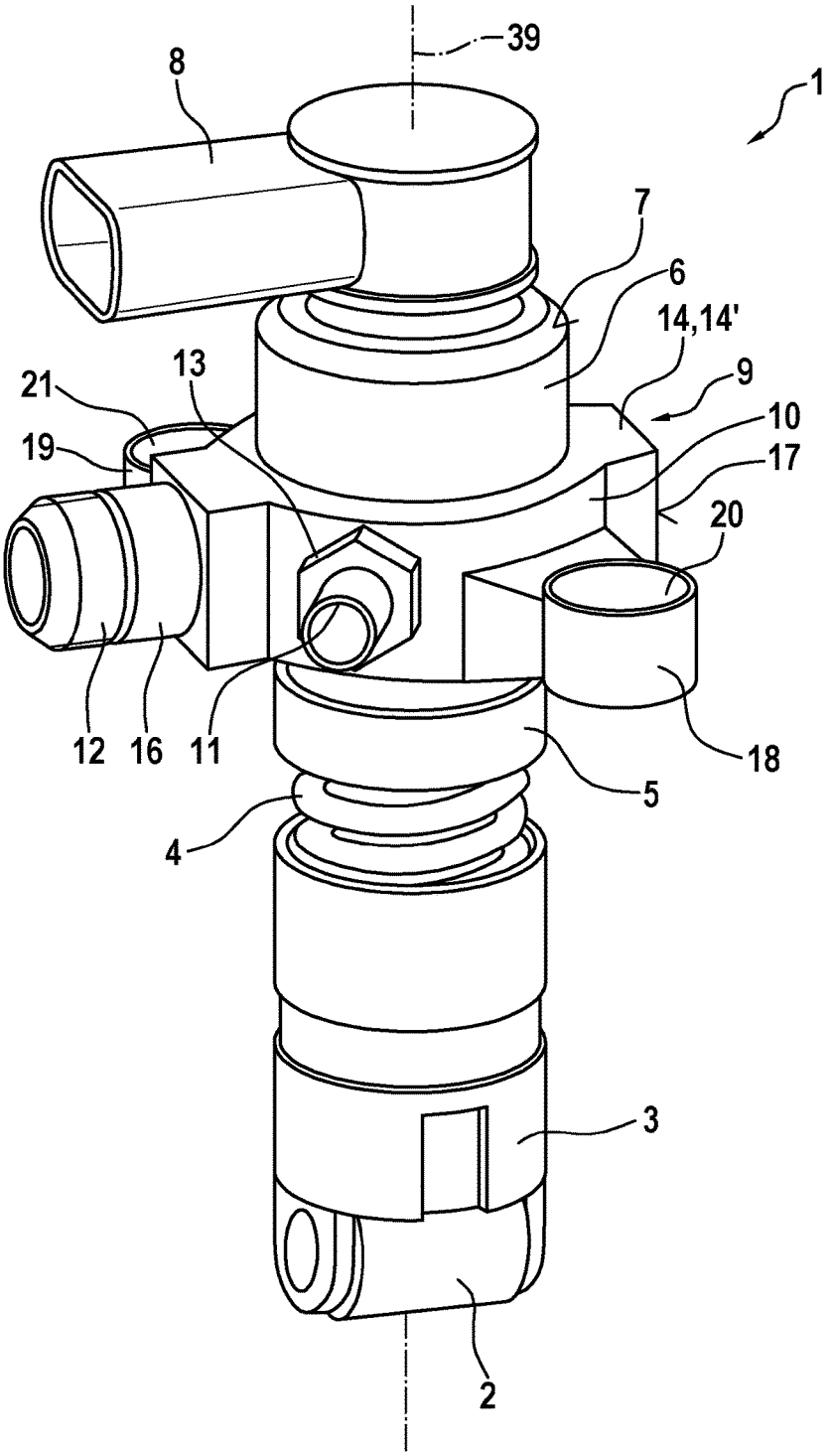
FIG. 1 shows a high-pressure pump in a partial, spatial depiction which corresponds to a first exemplary embodiment of the invention.

FIG. 1 shows a high-pressure pump 1 in a partial, spatial depiction according to a first exemplary embodiment. The high-pressure pump 1 is designed as a plug-in pump for an internal combustion engine. Depending on the design, the high-pressure pump 1 can be configured as a radial or in-line piston pump for fuel injection systems. The high-pressure pump is especially used in air-compressing, auto-ignition internal combustion engines, wherein the fuel is preferably conveyed into a fuel rail. The high-pressure pump 1 according to the invention is, however, suitable for other applications.

The high-pressure pump 1 has a roller 2 and a roller support 3. The roller support 3 accommodates the roller 2. The high-pressure pump 1 further has a tappet spring which, during operation, impinges the roller 2 against a running surface of a cam of a drive shaft for said high-pressure pump 1. In addition, the high-pressure pump 1 has a first fastening member 5, which is of annular design, and a second fastening member 6, which is of annular design and is provided with a chamfer 7. The high-pressure pump 1 furthermore has an electrical connector 8 in this exemplary embodiment in order to enable a connection of a control cable to an electrical control valve which can be disposed within the fastening member 6.

The high-pressure pump 1 has a cylinder head 9 which comprises a base 10, a low-pressure inlet connecting piece 11 and a high-pressure screw connection 12. In this case, provision is made for a plurality of low-pressure connecting points 13, 14. In this exemplary embodiment, the low-pressure inlet connecting piece 11 is fitted to the low-pressure connecting point 13. The high-pressure screw connection 12 is fitted to a high-pressure outlet 16 of the base 10.

In this exemplary embodiment, the low-pressure connecting point 14 is provided on a radial projection 14' of the base 10. The low-pressure connecting point 14 is hereby closed by an outer wall 17 of the base 10 because the opening for the low pressure is already implemented at the low-pressure inlet connecting piece 11.

Mounting brackets 18, 19 are integrally formed on the base 10, which in this exemplary embodiment are configured as screw brackets 18, 19 comprising through bores 20, 21. The through bores 20, 21 constitute special mounting recesses 20, 21 which can be used as screw holes 20, 21. In a modified configuration, such mounting recesses 20, 21 can however also be configured differently.

Figure 2:
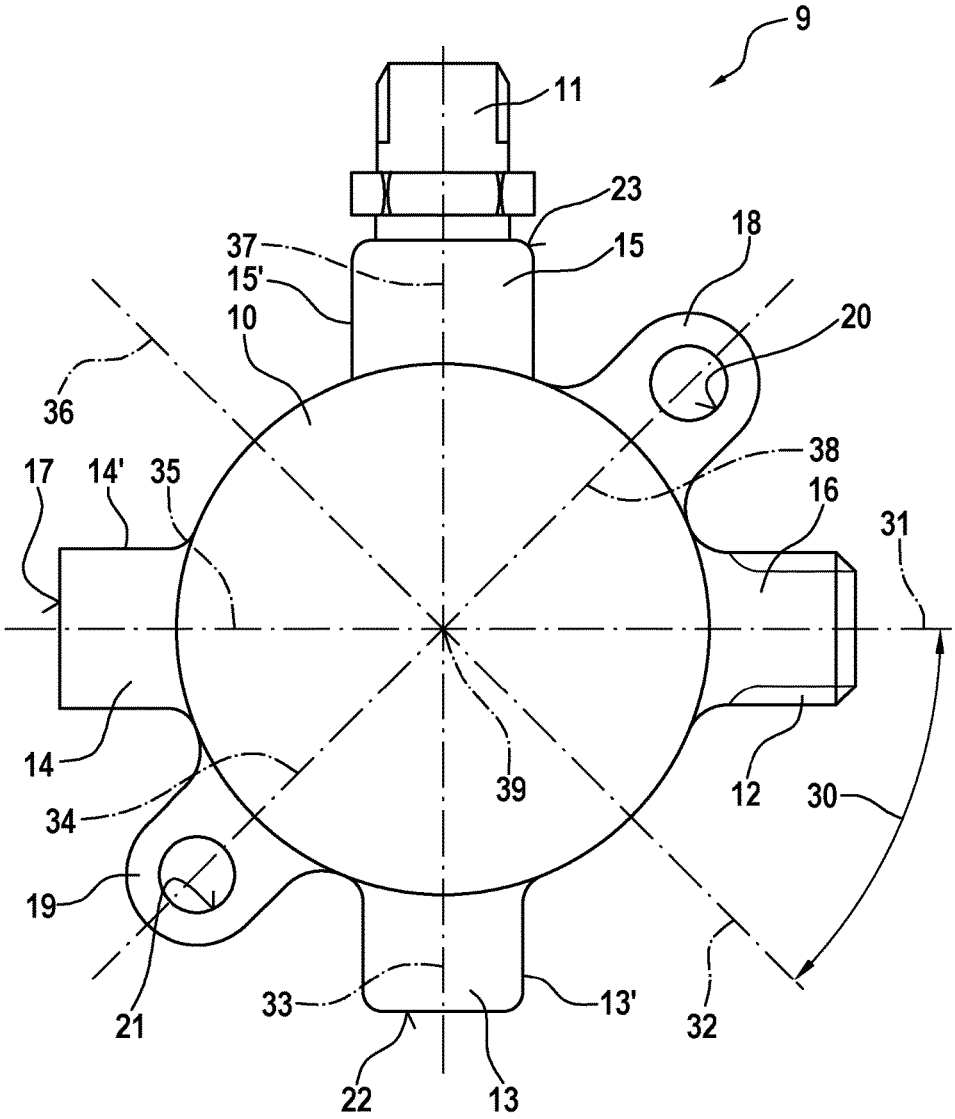
FIG. 2 shows a cylinder head of the high pressure pump depicted in FIG. 1 in a partial, schematic diagram which corresponds to a second exemplary embodiment of the invention.

FIG. 2 shows a cylinder head 9 of the high-pressure pump 1 depicted in FIG. 1 in a partial schematic depiction according to a second exemplary embodiment. In this exemplary embodiment, radial projections 13', 14', 15' are formed on the base 10. Low-pressure connecting points 13, 14, 15 are provided on the radial projections 13', 14', 15'. The radial projection 14' is closed by an outer wall 17 of the base 10. The radial projection 13' is correspondingly closed by an outer wall 22 of the base 10. In the raw state, the radial projection 15' is also closed by a closed outer wall 23. In the machined state depicted in FIG. 2, the outer wall 23 of the cylinder head 9 is however perforated, wherein a thread is designed for screwing in the low-pressure inlet connecting piece 11. In relation to the respective application, the outer wall 22 at the low-pressure connecting point 13 or the outer wall 17 at the low-pressure connecting point 14 can also be opened here instead of the outer wall 23 in order to mount the low-pressure inlet connecting piece 11 at the low-pressure connecting point 13 or, respectively, at the low-pressure connecting point 14. Different positions, at which the low-pressure inlet connecting piece 11 can be positioned on the basis of the raw state, then arise with respect to the high-pressure outlet 16, whereat a high-pressure screw connection 12 is configured. In the raw state, the cylinder head 9 is configured as a cylinder head blank 9, which can therefore be reworked in a simple manner in relation to the respective application, in order to facilitate the adaptation to the respective application.

The cylinder head 9 has a plurality of low-pressure connecting points 13, 14, 15, three low-pressure connecting points 13, 14, 15 being provided in this exemplary embodiment. In a modified configuration, another number of low-pressure connecting points can, however, also be implemented. The number of low-pressure connecting points of the base 10 is preferably selected to equal 3, 4 or 5.

In this exemplary embodiment, a specific basic angle 30 is specified. The specific basic angle 30 is equal to 45° in this exemplary embodiment 30. In relation to the basic angle 30, the high-pressure outlet 16, the three low-pressure connecting points 13, 14, 15 and the two mounting brackets 18, 19 are disposed at angular positions 31 to 38 which are integer multiples of the specific basic angle 30. In this case, the arrangement is distributed around the perimeter of the base 10 with respect to a longitudinal axis 39 of the cylinder head 9 or, respectively, the high-pressure pump 1. If the angular position 31 of the high-pressure outlet 16 is defined at 0°, the low-pressure connecting points 13, 14, 15 then lie at the angular positions 33, 35, 37 which are then equal to 90°, 180° and 270°. The mounting brackets 18, 19 then lie at angular positions 34, 38 of 135° and 315°. The angular positions 32, 36 of 45° and 225° then remain unoccupied in this exemplary embodiment.

Because the angular positions 34, 38 differ by 180°, said angular positions lie opposite one another. As a result, the two mounting brackets 18, 19 are disposed opposite one another. This has a favorable effect on the force transmission during mounting and thus on the sealing to be achieved. In so doing, the cylinder head 9 can be mounted in an advantageous manner between the first fastening member 5 and the second fastening member 6 of the high-pressure pump 1. The cylinder head can hereby be mounted, for example, on an internal combustion engine or on a housing of the high-pressure pump 1.

A low-pressure connection 11, which, in this exemplary embodiment, is formed by the low-pressure inlet connecting piece 11 that is screwed into the base, can therefore be fitted to each of the low-pressure connecting points 13, 14, 15 in a cylinder head blank 9. In a modified configuration, a corresponding machining of the base is, however, also conceivable.

Figure 3:
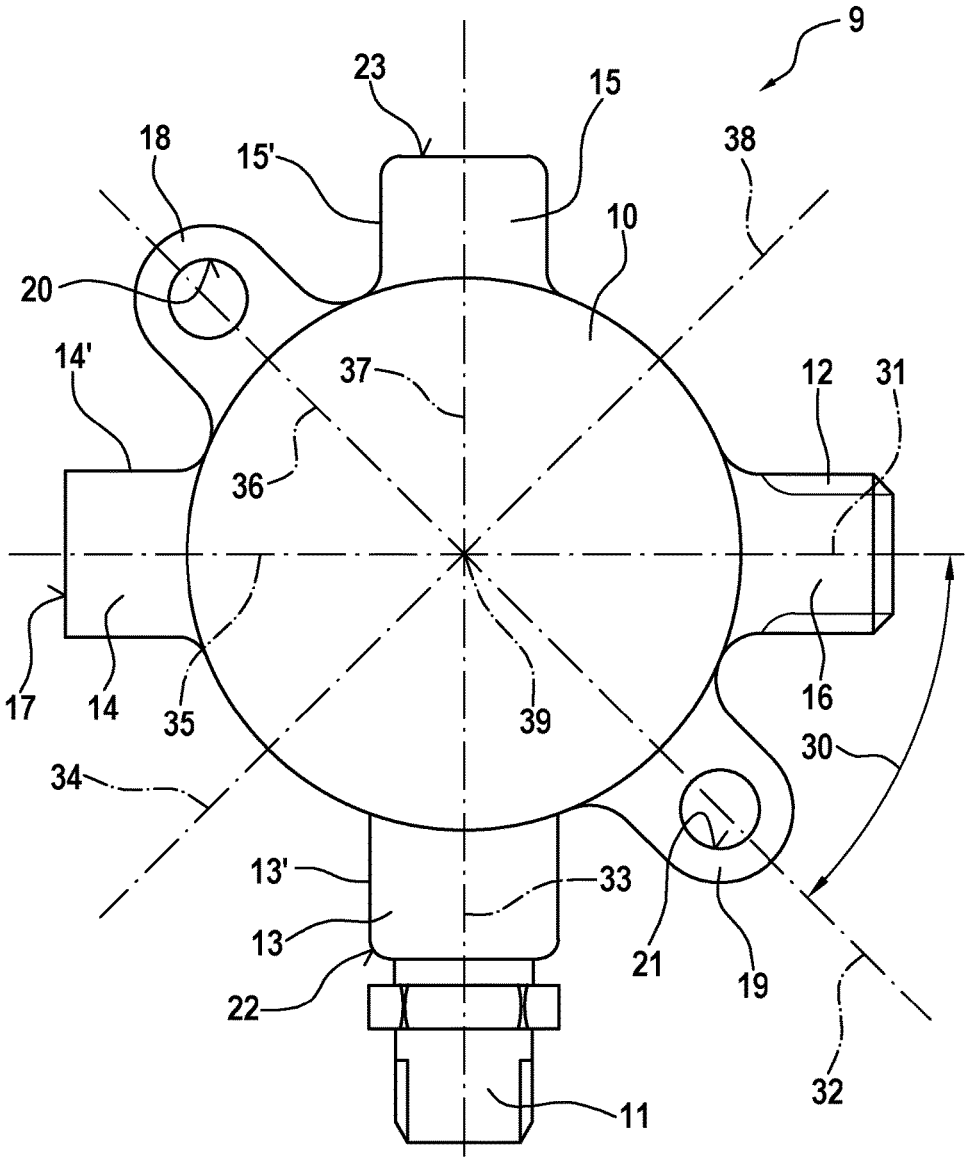
FIG. 3 shows a cylinder head of the high-pressure pump depicted in FIG. 1 in a partial, schematic depiction which corresponds to a third exemplary embodiment of the invention.

FIG. 3 shows a cylinder head 9 of the high-pressure pump 1 depicted in FIG. 1 in a partial, schematic depiction corresponding to a third exemplary embodiment. In this exemplary embodiment, the low-pressure inlet connecting piece 11 is provided at the low-pressure connecting point 13, which is disposed at the angular position 33. In addition, the mounting brackets 18, 19 are disposed at the angular positions 32, 36 in this exemplary embodiment. In the raw state, the cylinder blank 9 of the second exemplary embodiment, which is depicted in FIG. 2, and the cylinder blank 9 of the third exemplary embodiment, which is depicted in FIG. 3, are configured mirror-symmetrically to one another. Within the scope of a modular design of the high-pressure pump 1, an adaptation to different screw hole patterns can therefore also take place with respect to the high-pressure outlet 16.

A cost-effective manufacture of the high-pressure pump 1 is therefore possible without complicated set-up processes with regard to different applications.

The invention is not limited to the exemplary embodiments described above.

The invention claimed is:

1. A cylinder head blank (9) for a high-pressure pump (1), comprising a base (10) on which a high-pressure outlet (16) and a plurality of low-pressure connecting points (13-15) are closed in a raw state, and each of the low-pressure connecting points (13-15) being configured to have fitted thereto a low-pressure connection (11).

2. The cylinder head blank (9) according to claim 1, characterized in that
at least one of the low-pressure connecting points (13-15) is closed in the raw state by an outer wall (17, 22, 23) of the base (10).

3. The cylinder head blank according to claim 1, characterized in that
at least one of the low-pressure connecting points (13, 14, 15) is provided on a radial projection (13', 14', 15') of the base (10).

4. The cylinder head blank according to claim 1, characterized in that
at least one mounting bracket (18, 19) is integrally formed onto the base (10).

5. The cylinder head blank according to claim 4, characterized in that
the high-pressure outlet (16), the plurality of low-pressure connections (13-15) and the at least one mounting bracket (18, 19) are disposed so as to be distributed around the perimeter of the base (10) at least approximately at angular positions (31-38) which are integer multiples of a specific basic angle (30).

6. The cylinder head blank according to claim 5, characterized in that
the specific basic angle (30) is equal to 45°.

7. The cylinder head blank according to claim 4, characterized in that
two mounting brackets (18, 19) are provided which are disposed at least approximately at angular positions (34, 38; 32, 36) that are opposite one another.

8. The cylinder head blank according to claim 1, characterized in that
the number of the low-pressure connecting points (13-15) is equal to 3.

9. A cylinder head (9) for a high-pressure pump (1), comprising a cylinder head blank (9) according to claim 1, wherein a low-pressure inlet connecting piece (11) is screwed as a low-pressure connection (11) into the base (10) at one of the low-pressure connecting points (13-15).

10. A high-pressure pump (1), comprising at least one cylinder head (9) according to claim 9.

11. The cylinder head blank according to claim 1, characterized in that
the number of the low-pressure connecting points (13-15) is equal to 4.

12. The cylinder head blank according to claim 1, characterized in that
the number of the low-pressure connecting points (13-15) is equal to 5.

13. The cylinder head blank (9) according to claim 1, wherein the blank is configured for use in a radial or in-line piston pump for fuel injection systems of air-compressing, auto-ignition internal combustion engines.

14. A cylinder head (9) for a high-pressure pump (1), which is configured as a radial or in-line piston pump for fuel injection systems of air-compressing, auto-ignition internal combustion engines, comprising a cylinder head blank (9) according to claim 13, wherein a low-pressure inlet connecting piece (11) is screwed as a low-pressure connection (11) into the base (10) at one of the low-pressure connecting points (13-15).

15. A high-pressure pump (1), which is a radial or in-line piston pump for fuel injection systems of air-compressing, auto-ignition internal combustion engines, comprising at least one cylinder head (9) according to claim 14.

* * * * *